US007909352B2

(12) United States Patent
Girard et al.

(10) Patent No.: US 7,909,352 B2
(45) Date of Patent: Mar. 22, 2011

(54) ARTICLE INCLUDING A BUTTON WHICH IS MOVABLE BETWEEN AT LEAST TWO POSITIONS

(75) Inventors: François Girard, Veyrier du Lac (FR); Eddy Yelovina, Seynod (FR)

(73) Assignee: Salomon S.A.S., Metz - Tessy (FR)

( * ) Notice: Subject to any disclaimer, the term of this patent is extended or adjusted under 35 U.S.C. 154(b) by 522 days.

(21) Appl. No.: 11/959,935

(22) Filed: Dec. 19, 2007

(65) Prior Publication Data

US 2008/0150256 A1 Jun. 26, 2008

(30) Foreign Application Priority Data

Dec. 20, 2006 (FR) ..... 06 11119

(51) Int. Cl.
*A63C 9/00* (2006.01)

(52) U.S. Cl. ..... 280/612; 280/611; 280/615

(58) Field of Classification Search ..... 280/611, 280/613, 615, 623, 11.3, 11.33
See application file for complete search history.

(56) References Cited

U.S. PATENT DOCUMENTS

| | | | | | |
|---|---|---|---|---|---|
| 3,246,907 | A | * | 4/1966 | Chisholm | 280/612 |
| 3,469,857 | A | | 9/1969 | Smolka et al. | |
| 4,219,215 | A | * | 8/1980 | Biermann et al. | 280/615 |
| 4,309,044 | A | * | 1/1982 | Schmidt | 280/615 |
| 5,052,710 | A | * | 10/1991 | Provence et al. | 280/615 |
| 5,085,453 | A | * | 2/1992 | Bildner | 280/612 |
| 5,092,620 | A | * | 3/1992 | Girault et al. | 280/615 |
| 5,338,053 | A | * | 8/1994 | Hauglin | 280/615 |
| 5,671,941 | A | * | 9/1997 | Girard | 280/615 |
| 5,794,963 | A | * | 8/1998 | Girard | 280/615 |
| 5,957,478 | A | * | 9/1999 | Vigny | 280/615 |
| 6,017,050 | A | * | 1/2000 | Girard | 280/615 |
| 6,027,135 | A | * | 2/2000 | Hauglin | 280/615 |
| 6,289,610 | B1 | * | 9/2001 | Girard et al. | 36/117.2 |
| 6,435,537 | B2 | * | 8/2002 | Veux | 280/615 |
| 6,644,683 | B1 | * | 11/2003 | Hauglin et al. | 280/613 |
| 6,811,177 | B2 | * | 11/2004 | Lancon et al. | 280/615 |
| 6,986,526 | B2 | * | 1/2006 | Haughlin | 280/613 |
| 2004/0056449 | A1 | * | 3/2004 | Girard et al. | 280/615 |
| 2004/0262886 | A1 | * | 12/2004 | Girard | 280/615 |
| 2006/0197312 | A1 | * | 9/2006 | Girard et al. | 280/613 |
| 2009/0230667 | A1 | * | 9/2009 | Starry | 280/814 |

FOREIGN PATENT DOCUMENTS

| | | | | |
|---|---|---|---|---|
| EP | 0 913 102 | B1 | | 5/1999 |
| EP | 0 913 103 | B1 | | 5/1999 |
| FR | 1546438 | A | * | 7/1968 |
| FR | 1 546 438 | A | | 11/1968 |
| FR | 2 882 658 | A1 | | 9/2006 |

* cited by examiner

*Primary Examiner* — J. Allen Shriver, II
*Assistant Examiner* — Jacob Meyer
(74) *Attorney, Agent, or Firm* — Greenblum & Bernstein, P.L.C.

(57) ABSTRACT

An article, such as an alpine or cross-country binding, provided to be associated with a sports apparatus, such as a ski, the article including a control mechanism movable between at least two positions. The control mechanism includes an arrangement for attracting an actuating member, such as the end of a ski pole, that is separate from the article.

21 Claims, 7 Drawing Sheets

ARTICLE INCLUDING A BUTTON WHICH IS MOVABLE BETWEEN AT LEAST TWO POSITIONS

CROSS-REFERENCE TO RELATED APPLICATION

This application claims priority under 35 U.S.C. §119 of French Patent Application No. 06 11119, filed on Dec. 20, 2006, the disclosure of which is hereby incorporated by reference thereto in its entirety.

BACKGROUND OF THE INVENTION

1. Field of the Invention

The invention relates to the field of sports articles including a button that is movable between at least two positions.

The invention more particularly relates to a device for retaining an article of footwear onto a sports apparatus or a device for tightening a boot, provided with a button.

2. Description of Background and Other Information

Articles of the aforementioned type are used for the practice of various sports, such as gliding, rolling, and walking sports. More particularly, such sports include snow skiing, water-skiing, snowboarding, snowshoeing, roller-skating, and the like.

In the case of a device for retaining a boot on a gliding board, such as a binding for a cross-country ski, a button that is movable between at least two positions allows the boot to be released. This means that an actuation of the button allows the boot to separate from the device.

It is known that the button can be acted upon by pressing, especially against the action of an elastic mechanism, such as a spring. Such pressing can be carried out by hand or with a pole, such as a ski pole. In such a case, the skier moves one end of the pole toward the binding, contacts the button, and then presses to release the boot. This technique allows the skier to maintain an orthostatic position, which is more comfortable than bending the body. Thus, the pole extends the arm to allow the boot to be removed more comfortably.

However, despite the comfort of the skier, actuating the button by means of a pole presents certain drawbacks.

For example, the end of the pole is provided with a basket to allow the skier to be supported on the snow. The basket tends to hide the tip of the pole from the skier's sight. Therefore, because the skier cannot see whether he/she is correctly positioning the tip of the pole, the skier tends to fumble with the binding, delaying actuation of the button. The operation of the binding, therefore, tends to be inefficient. Frequently, the skier is required to press the button numerous times before finally managing to actuate it. In addition to wasting time, the action of the pole can damage other parts of the device, for example by scratching it, or it can alter the user's balance.

SUMMARY OF THE INVENTION

The invention facilitates movement of the tip of the pole on the button of a device for retaining a boot on a sports apparatus, such as a binding for a cross-country ski, thereby improving the efficiency of the device.

The same type of drawback mentioned above exists in alpine skiing, whereby the lever of the rear binding, or heel piece, is unlocked by means of a ski pole.

Therefore, in a more general manner, the invention improves the actuation of a button or lever of a sports article by means of an external member.

To this end, the invention provides an article adapted to be associated to a sports apparatus, the article including a control mechanism that is movable between at least a locking position and an unlocking position.

A control mechanism according to the invention includes an article having an arrangement to attract an actuating member separate from the article.

The attraction arrangement biases the separate member, such as a pole, toward the control mechanism, such as a button or a lever. Consequently, the user does not need to fumble to position the tip of the pole on the button or lever. The tip of the pole is attracted to its position on the control mechanism. This positioning is carried out with a minimum assistance from the user, which means that positioning the top of the pole is done rapidly and directly. The ease and rapidity of action are two of the resulting advantages.

BRIEF DESCRIPTION OF DRAWINGS

Other characteristics and advantages of the invention will be better understood from the description that follows, in reference to the annexed drawings showing, by means of non-limiting embodiments, how the invention can be implemented, and in which.

DETAILED DESCRIPTION OF THE INVENTION

Although the two first embodiments described hereinafter relate to a device for retaining a boot on a cross-country ski, i.e., a cross-country ski binding, they also apply to other articles such as mentioned above.

The first embodiment is schematically shown in FIGS. 1 to 8.

Figure 1:
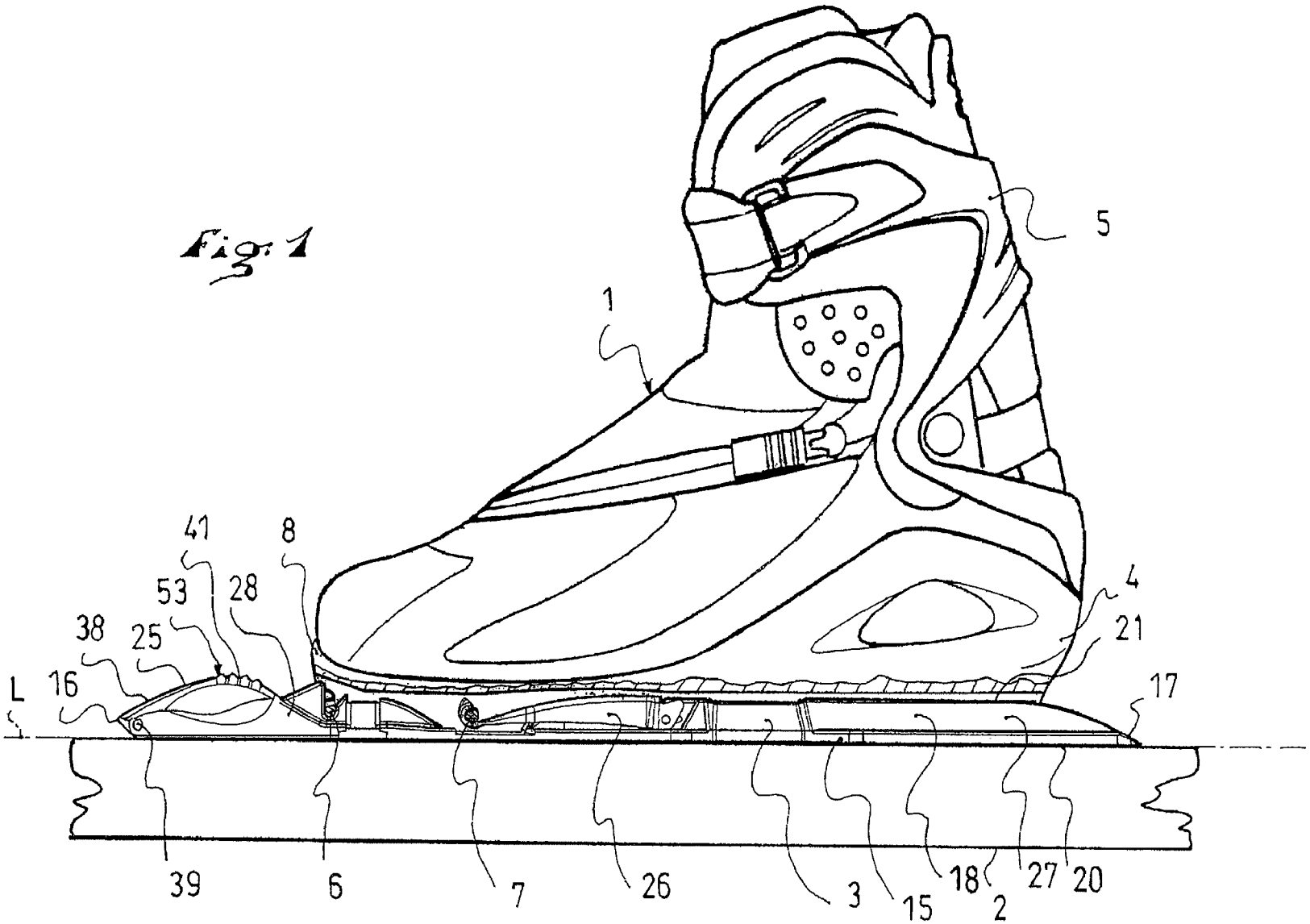
FIG. 1 is a side view of a device for retaining a boot on a ski, according to a first embodiment of the invention.

As shown in FIG. 1, a boot 1 is temporarily retained on an apparatus 2 by means of a retaining device or binding 3. The apparatus 2 is a cross-country ski, for example, the device 3 being a cross-country ski binding.

In a known manner, the boot 1 includes a sole 4 and an upper 5.

By way of example, the boot 1 includes a two-part connection to the binding 3.

Such connection includes one or two bars, pins, or rods, 6, 7, as in the embodiment shown, which are arranged in the sole 4 so as to be flush with the latter, or at least not projecting downwardly beyond the lowermost sole surface. The rods 6, 7, are known to one having ordinary skill in the art, examples being disclosed in patent documents EP 913 102; EP 913 103, and U.S. Pat. No. 6,289,610, the disclosure of U.S. Pat. No. 6,289,610 being herein incorporated by reference thereto in its entirety for this purpose. The two rods here are two cylindrical rotational rods arranged across a longitudinal groove housed in the sole, although such rods could, instead, be connection members having a different shape. The front rod 6 is located toward the front end 8 of the sole, for example, and the rear rod 7 is rearwardly offset so as to be arranged in the area of or at the front of a zone of the boot corresponding to the metatarsophalangeal flexion zone of the user's foot. This arrangement of the rods 6, 7 is advantageous in cross-country skiing because, with a boot provided with a flexible sole, the boot can thereby be maintained in a flexed position that corresponds to the flexed position of the foot.

Alternatively, the invention could be implemented with a connection to the binding having a different geometry or configuration, such as, for example, rods having non-circular cross-sections, hooks, projections or fastening grooves formed directly in the sole, or the like. As described above, the invention could be implemented with merely one rod or other connection member.

Figure 2:
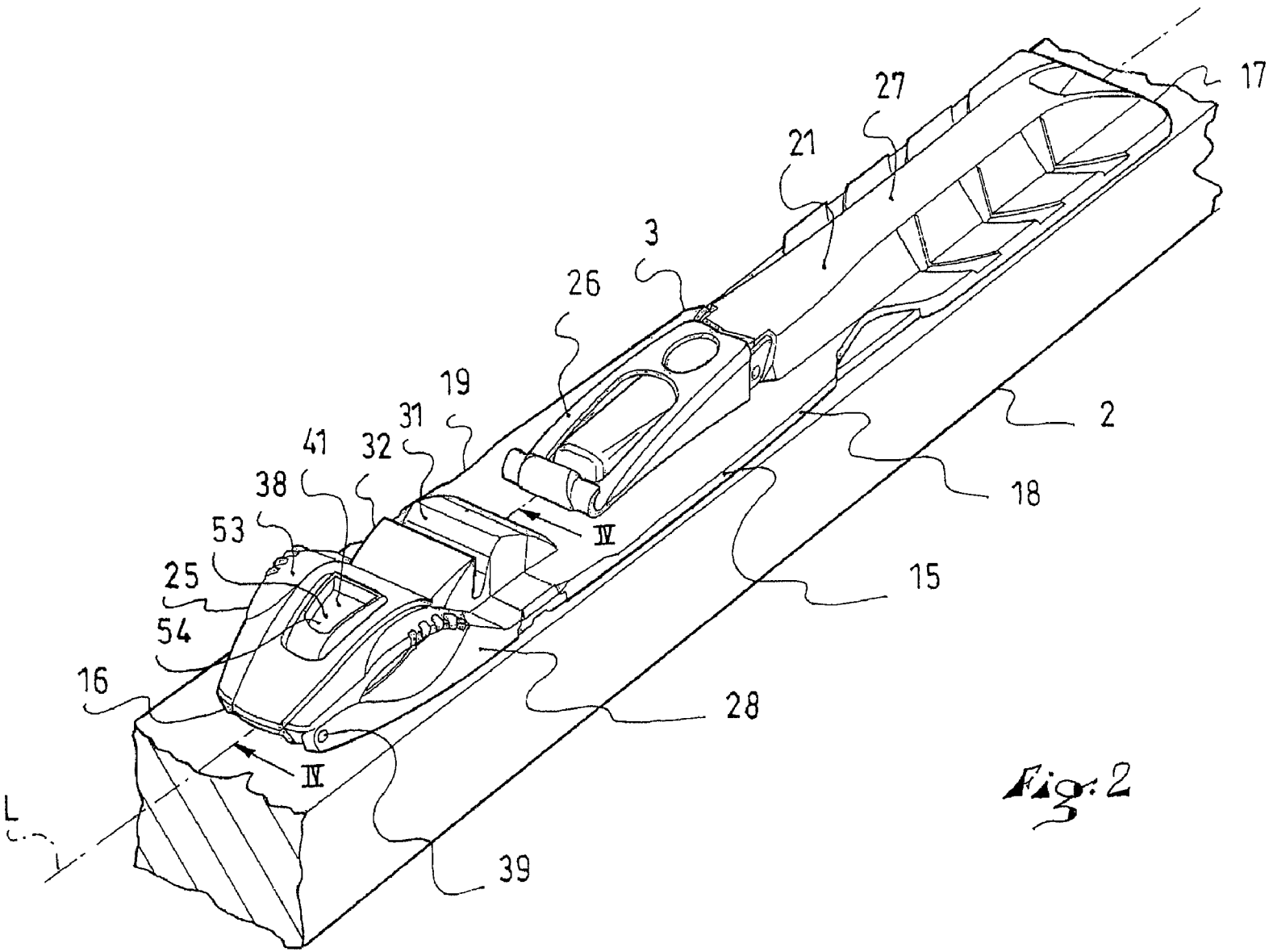
FIG. 2 is a front perspective view of the retaining device on the ski according to FIG. 1.

The retaining device 3, shown in FIG. 2, for example, includes a baseplate 15, which extends along a longitudinal direction L, from the front end 16 to the rear end 17, transversely from a first edge 18 to a second edge 19, and heightwise from a support surface 20 to a receiving surface 21. The support surface 20 is adapted to cover the ski 2, directly or indirectly. In the same context, the receiving surface 21 is adapted to receive the sole 4 of the boot.

To this end, the baseplate 15 carries a reversible locking mechanism 25 provided to retain the front rod 6 of the boot, an elastic return mechanism 26 provided to counter the movement of the rear rod 7 away from the baseplate 15, as well as a rib 27 for guiding the sole 4.

The locking mechanism 25 is well-known to one having ordinary skill in the art, for example, from the patent documents FR 2 882 658 and US 2006/0197312, the disclosure of the latter of which is hereby incorporated by reference thereto in its entirety. Therefore, the mode of operation of the locking mechanism 25 is only summarized herein.

Figure 3:
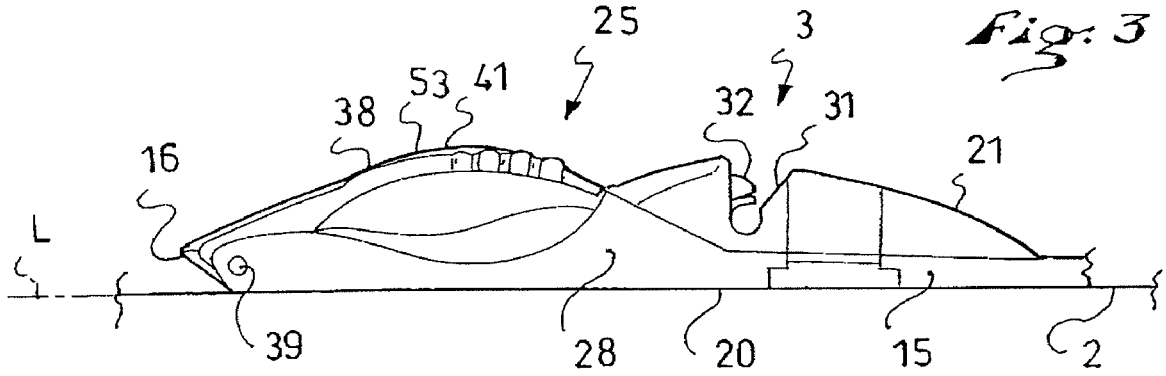
FIG. 3 is a partial side view of the device of FIG. 2, in a position for retaining the boot.
Figure 4:
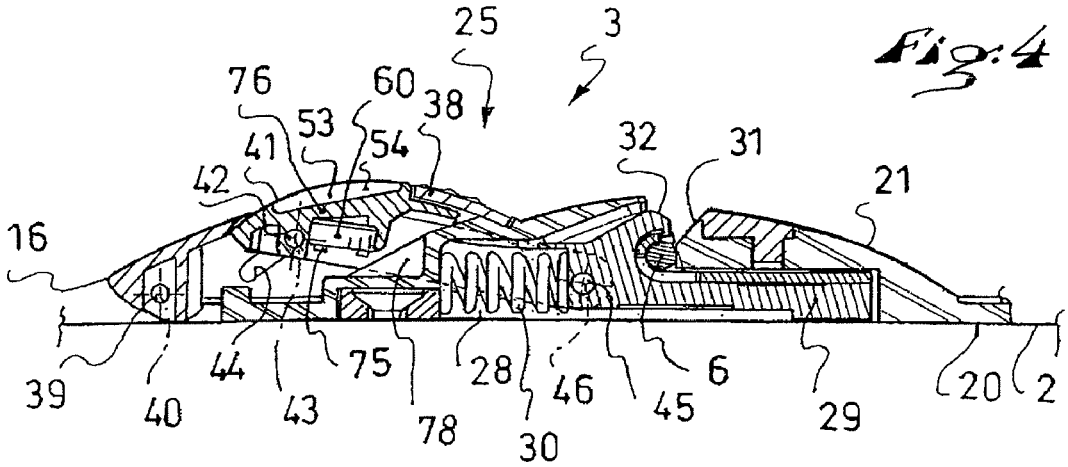
FIG. 4 is a partial cross-section of the device along the line IV-IV of FIG. 2, in a position for retaining the boot.

As shown particularly in FIGS. 3 and 4, the locking mechanism 25 includes a housing 28 for receiving a movable piece or slide 29 and spring 30, or other elastic expedient. The spring 30 can be a compression spring, for example. An area of the housing 28 forms a fixed jaw 31, whereas an extension of the slide 29 forms a movable jaw 32. The spring 30 constantly biases the movable jaw 32 toward the fixed jaw 31. Thereby, the front rod 6 of the boot, shown only for the purpose of facilitating an understanding of the invention, is retained by the locking mechanism 25.

The boot 1 can be released by means of a voluntary action performed by the user. To this end, the mechanism 25 includes a lever 38 pivoted, or otherwise articulated, with respect to the housing 28 about a swivel pin 39 having a transverse axis 40, as well as a control member or button 41 that connects the lever 38 to the slide 29. A connection including, for example, a swivel pin 42 extending along a transverse axis 43, connects the button 41 to the lever 38.

This swivel pin extends through a hole of the button 41 along the axis 43 and cooperates with a slot 44 of the lever 38. In addition, another connection, which includes, for example, a swivel pin 45 with a transverse axis 46, connects the button 41 to the slide 29. The lever 38 and the button 41 control the locking and the unlocking of the retaining device.

Figure 5:
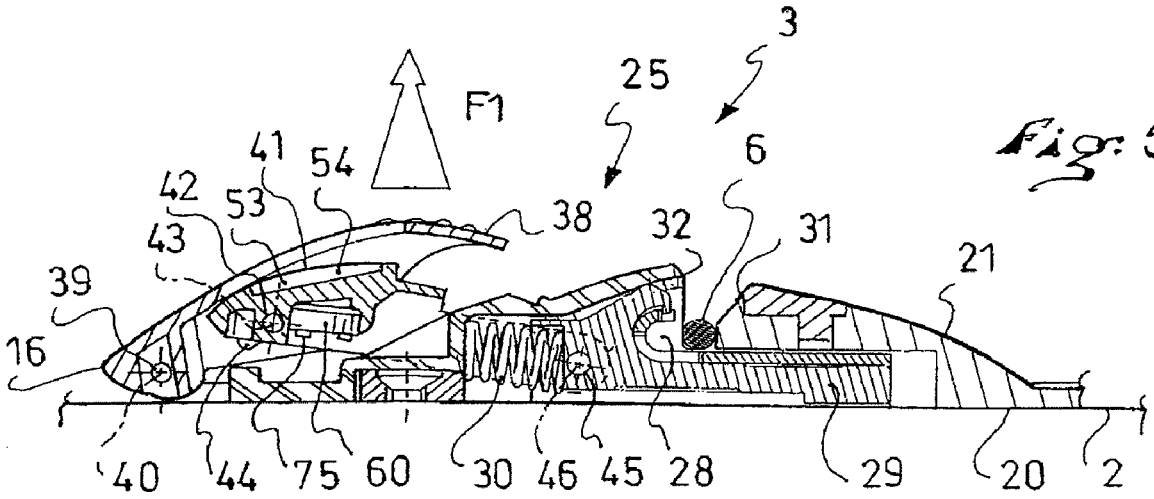
FIG. 5 is a partial cross-section of the device similar to FIG. 4, for a first mode for releasing the boot.
Figure 6:
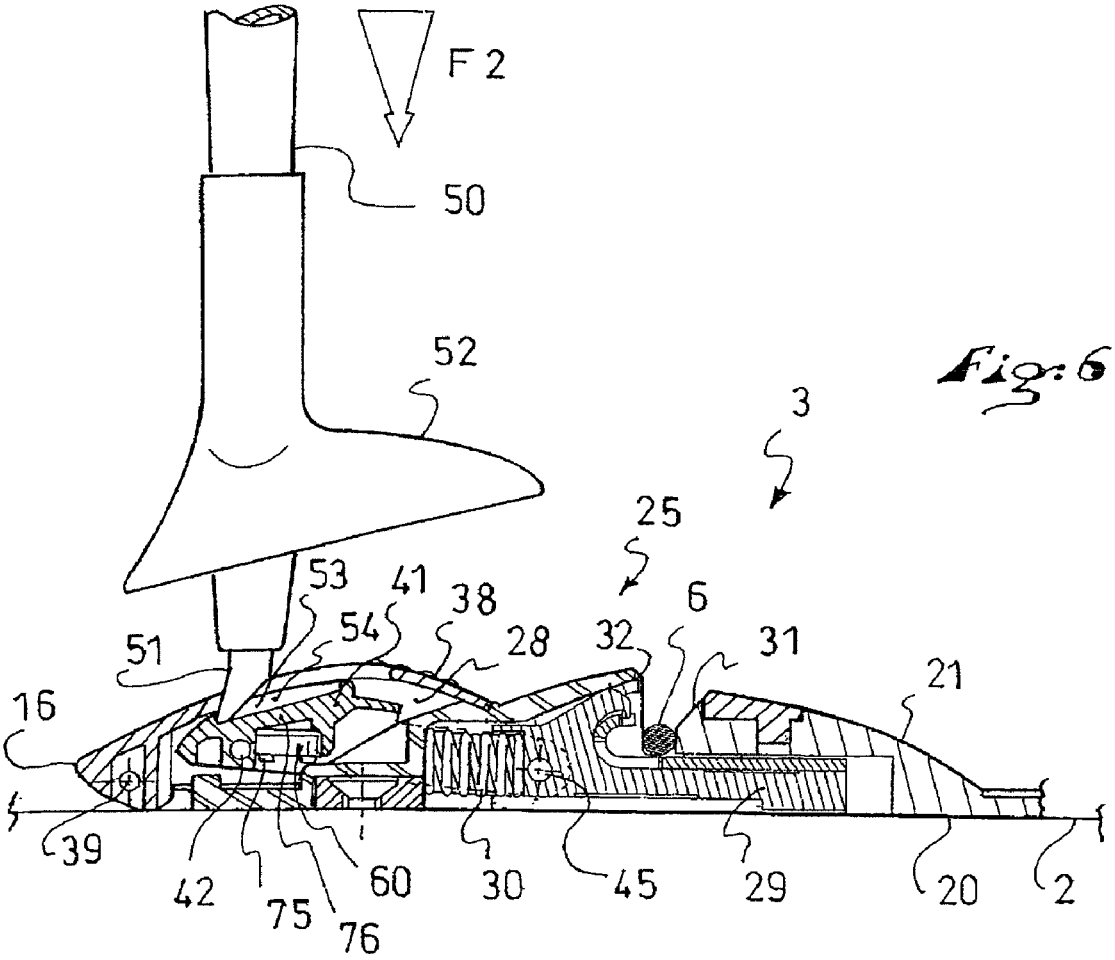
FIG. 6 is a partial cross-section of the device similar to FIG. 4, for a second mode for releasing the boot.

The locking mechanism 25 operates in a manner schematically shown in FIGS. 5 and 6. In fact, the user can unlock the mechanism 25 by means of either one of two modes of operation.

The first mode, illustrated by FIG. 5, involves manually biasing the lever 38 in traction, i.e., pulling upwardly on the lever 38. Such biasing shown schematically by the arrow F1, acts in a direction along which the lever 38 moves away from the receiving surface 21 of the device. The biasing causes the lever 38 to rotate about the axis 40 and causes the button 41 to be raised and moved forward. Such movement of the button drives the slide 29 toward the front 16 against the action of the elastic spring 30 in this embodiment. This moves the jaws 31, 32 away from one another, i.e., the jaws are moved apart, whereby the front rod 6 of the boot can then be disengaged, i.e., released from the locking mechanism 25.

According to the first embodiment of the invention, the button 41 can be regarded as an intermediary between the lever 38 and the slide 29.

When the traction force in the direction F1 is stopped, the slide, the button, and the lever each return to a folded position, for which the mechanism 25 retains the rod 6.

The second mode of operation according to FIG. 6 involves biasing the button 41 directly in compression. This application of force, shown schematically by the arrow F2, acts downwardly, i.e., in a direction by which the button 41 is moved closer to the receiving surface 21. The biasing lowers the button 41 and moves it forward. This effect is obtained by sliding the swivel pin 42 in the slot 44. The lever 38 remains immobile, but the slide 29 moves again against the action of the spring 30. The jaws 31, 32 move away from one another. The mechanism 25 is opened.

The biasing in compression F2 can be carried out with a member separate from the device 3. This member is a ski pole 50, for example, which includes a metallic tip or nib 51 provided to penetrate into the ice and snow, as well as a basket 52 adapted to provide support on the snow. The basket widens the surface area of the tip 51 to provide the pole with sufficient support surface.

To receive the tip 51 of the pole, the button 41 has a receiving zone 53, which is made in the form of a cavity 54, i.e., a depression or open recess, for example, arranged in the button. However, the receiving zone 53 could also have any appropriate structure, such as a raised portion projecting with respect to the button 41.

According to the first embodiment of the invention, the user brings the tip 51 of the pole to the receiving zone 53, in this case the recess 54, when he wants to actuate the button 41 directly. This maneuver is hindered by the basket 52, which hides the button 41 from the user's sight.

For this reason, the invention provides for the button 41 to include an arrangement to attract a separate actuating member, i.e., such as a pole 50.

The attraction arrangement biases the tip 51 of the pole toward the receiving zone 53 of the button. In this way, the tip naturally moves toward the button 41, even though it is hidden from the user's sight by the basket 52. The user only has to move the tip of the pole toward the mechanism 25, while avoiding fumbling that is characteristic of known bindings. As contrasted with conventional bindings, the binding of the invention allows the user to achieve the release of the boot easily and quickly.

Figure 7:
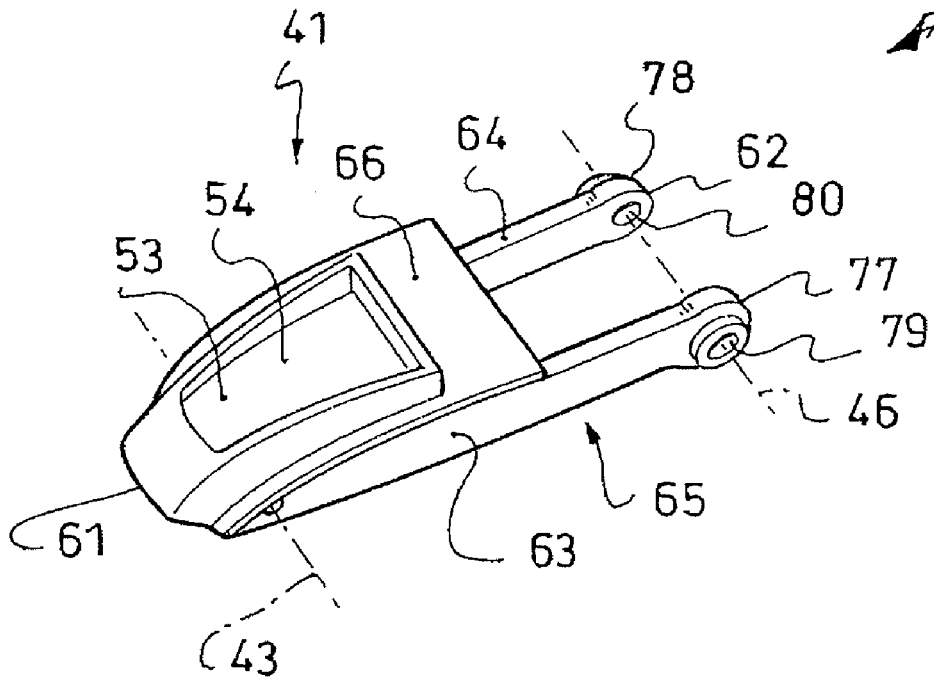
FIG. 7 is a top perspective view of a piece forming a button of the device of FIG. 2.
Figure 8:
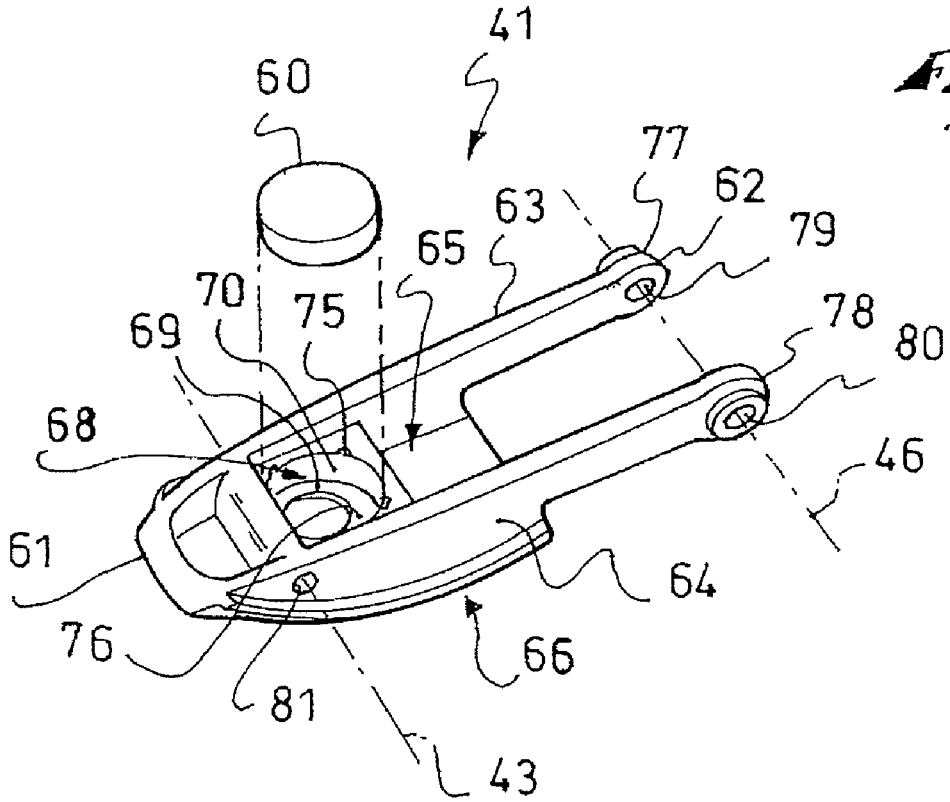
FIG. 8 is a bottom perspective view of the piece according to FIG. 7.

According to the first embodiment, as shown in FIGS. 4 to 6 as well as in FIGS. 7 and 8, the attraction arrangement includes a magnet 60 capable of attracting the metallic tip 51 of the pole or a metallic piece adapted to attract a magnet housed inside the tip or other portion of the pole. This means that the button 41 includes a magnet 60 or a piece capable of attracting a magnet.

The magnet 60 is associated with the button 41, as can be better understood by means of FIGS. 7 and 8.

Generally speaking, the button 41 extends lengthwise from a front end 61 to a rear end 62, widthwise between a first lateral edge 63 and a second lateral edge 64, and thicknesswise between an inner surface 65 and an outer surface 66.

The inner surface 65 is turned toward the housing 28 of the locking mechanism 25. The outer surface 66 is turned outward from the mechanism 25 so as to be accessible to the ski pole or the skier. Therefore, the zone 53 for receiving the tip of the pole, in this case the recess 54, is arranged on the outer surface 66, the recess thereby constituting an outer recess. Further, as shown in FIG. 4 in particular, at least in a locking position the outer recess 54 is recessed, front and rear, within the adjacent outermost surface of the control/locking mechanism—in this case the outermost adjacent surface of the lever 38.

According to the first embodiment, the magnet 60 is associated with the button 41 on the side of the inner surface 65, opposite the outer surface 66. More precisely, the magnet 60 is housed in an inner recess 68 of the button, the recess 68 being open and opening out onto the side of the inner surface 65. In other words, the recess 68 is outwardly closed. More generally, one could say that the magnet is located on the control mechanism 41, i.e., on the button. The recess 68 has a bottom 69, an inlet spaced upwardly from the bottom in FIG. 8, as well as a periphery 70, generally cylindrical in FIG. 8, that connects the inlet to the bottom.

In a non-limiting manner, the inner recess 68 has a generally circular cross-sectional shape. By analogy, the magnet 60 also has a generally circular cross-sectional shape. The magnet in this case is made in the form of a flat disk. The shapes of the inner recess 68 and magnet 60 complement one another, that is, they are provided such that the magnet becomes nested into the recess.

Therefore, the inner recess 68 has a diameter and a depth equal to or slightly greater than the diameter and thickness of the magnet 60.

The magnet 60 and the button 41 are associated together by the insertion of the magnet into the inner recess 68. A retaining arrangement maintains the magnet 60 in place in the inner recess 68. This arrangement includes, for example, material extensions 75 originating from the inner surface 65 and bent over the inlet of the inner recess 68. The extensions are bent back after the magnet 60 has been positioned. Thereby, the magnet is retained within the button 41. In other words, the magnet 60 is set in the inner recess 68 of the button 41. More particularly, according to an embodiment of the invention in which the button 41 of FIGS. 7 and 8 is a molded plastic part, the extensions 75 can be prongs which are sufficiently flexible to allow the magnet 60 to bend them back as the magnet is being inserted within the inner recess 68 and then snap back over the magnet as the magnet is fully received in the inner recess 68.

Alternatively, other arrangements can be provided as a magnet retaining arrangement. Such arrangements, for example, include gluing the magnet in place in the inner recess 68, or enclosing it with a cap or any equivalent, or the like.

A wall 76 of the button 41 separates the magnet 60 from the tip 51 of the pole when the tip is in the open outer recess 54. This is shown in FIG. 6. In fact, the wall 76 demarcates the bottom 69 of the inner recess 68, as well as the bottom of the outer recess 54. As a result, the action of the magnet 60 is carried out through the wall 76, that is, indirectly. Alternatively, the magnet could be positioned in the outer recess 54. As shown in FIGS. 5 and 6 of the exemplary embodiment, e.g., the lengthwise extent of the outer recess 54 of the control member/button 41, within which the tip 51 of the pole is received, is greater than the lengthwise dimension of the magnet 60, i.e., the diameter of the cylindrical magnet 60. This relationship, i.e., a relatively elongated outer receiving surface compared to the size of the magnet, inherently, facilitates placement of the ski tip 51. FIG. 6 also shows the tip 51 of the pole engaged with a front end of the outer recess 54 spaced forwardly of the magnet 60. In addition, the rear end of the outer recess is spaced rearwardly of the magnet.

The button 41 includes one or several materials that enable a magnetic field to pass through. For example, the button 41 can be a piece made of plastic material, such as polyurethane, polyamide, or any equivalent material. According to the first embodiment, the button 41 is a unitary piece, which facilitates making the rear end 62 in two parts or arms 77, 78. The arms 77, 78 demarcate openings 79, 80 for the swivel pin 45 having an axis 46. The arms 77, 78 extend on respective opposite sides of the slide 29 and receive the spring 30 therebetween. The front end 61 demarcates an opening 81 for the swivel pin 42 extending along axis 43. Therefore, the magnet 60 is housed between the swivel pins 42, 45.

Figure 9:
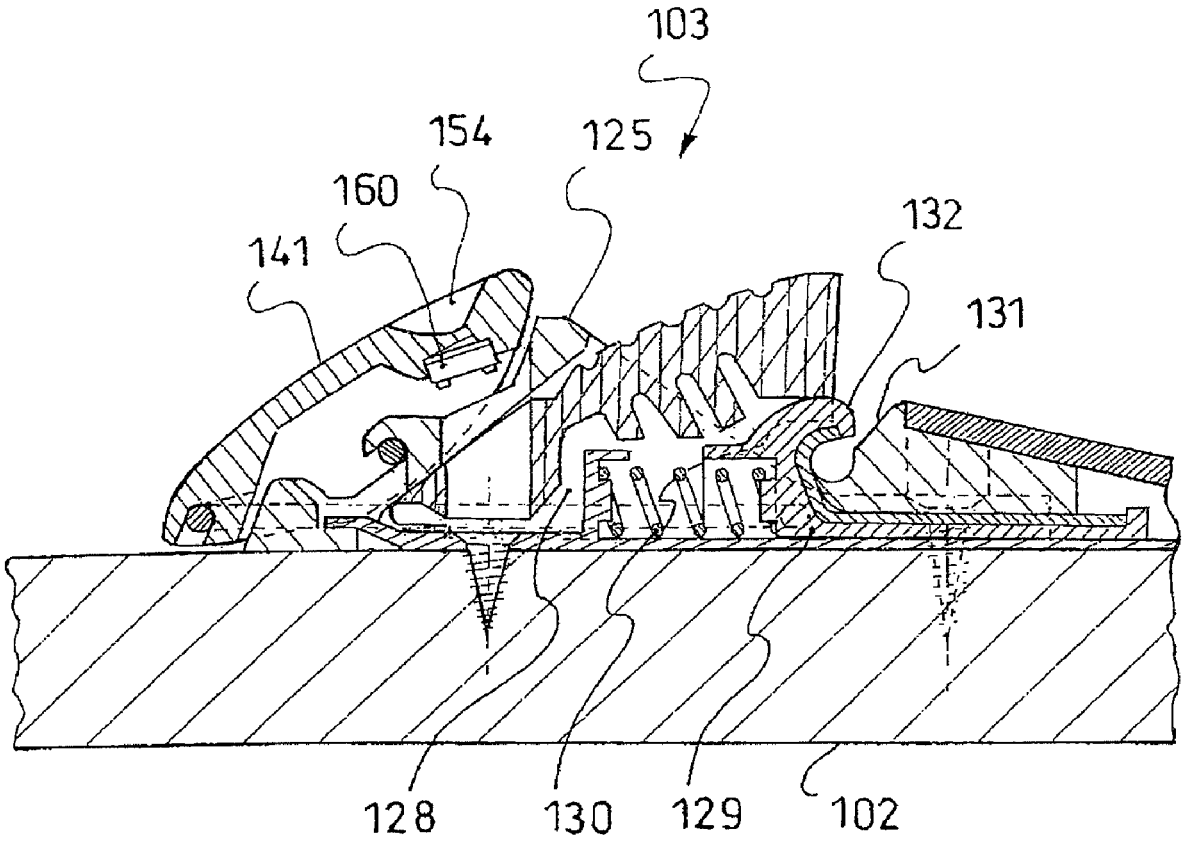
FIG. 9 is a partial longitudinal cross-section, similar to that of FIG. 4. for a second embodiment of the invention.
Figure 10:
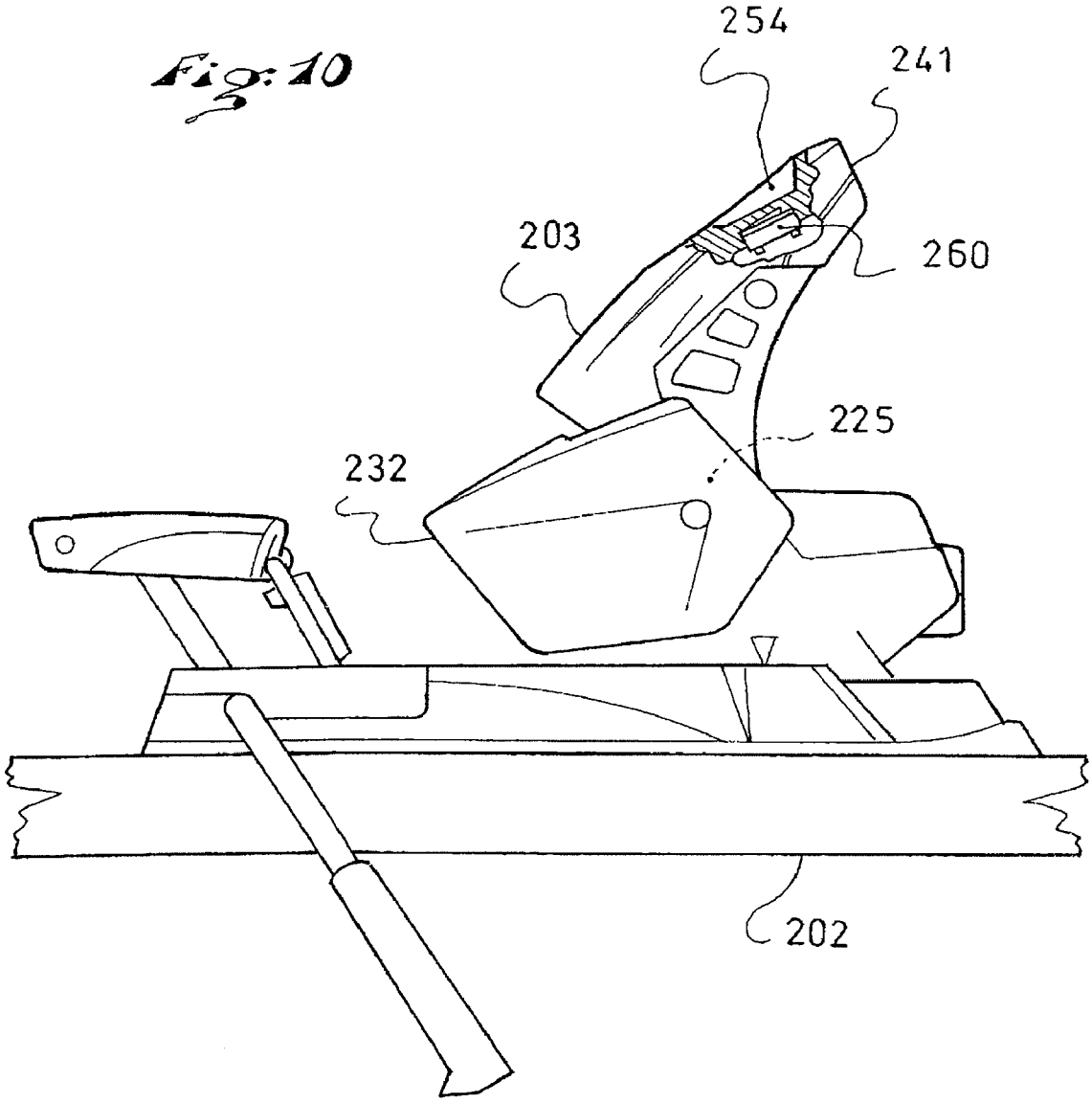
FIG. 10 is similar to FIG. 4 or 9, for a third embodiment of the invention.

Additional embodiments of the invention are shown in FIGS. 9 and 10. For reasons of convenience, only the elements necessary to the understanding are shown.

For the second embodiment, according to FIG. 9, the elements are designated by the same reference numerals as in the first embodiment, increased by one hundred. It includes a ski 102, a retaining device 103, a locking mechanism 125, a housing 128, a slide 129, a spring 130, a fixed jaw 131, a movable jaw 132, and a button 141 with an outer recess 154. A magnet 160 is housed in the button 141. The mode of operation for opening the mechanism 125 by means of a pole requires, in this case also, pressing on the outer recess 154.

A particular difference between the first and the second embodiments is the lack of a traction lever. Therefore, unlocking of the binding is achieved only by actuating the button 141. In other words, the locking mechanism 125, according to the second embodiment, can be used according to a single mode of operation. The button 141 is the only element which controls the unlocking of the binding.

The elements of a third embodiment, according to FIG. 10, are referred to with the same numerals as those of the first embodiment increased by two hundred. Included are a ski 202 and a heelpiece 203, the latter being, in fact, part of the retaining device, or binding, provided to removably retain the rear of a boot, i.e., such as the heel, onto an alpine ski. Therefore, the heelpiece 203 includes a locking mechanism 225, a movable jaw 232 capable of cooperating with the boot sole, and a control arrangement or lever 241 with outer recess 254. A magnet 260 is housed in the lever 241. The mode of operation for opening the mechanism 225 by means of a pole can, in this case also, be carried out with a pressure applied to the outer recess 254, so as to pivot the lever 241 downward.

In a general manner, the invention is implemented from materials and according to implementation techniques known to one having ordinary skill in the art.

The invention is not limited to the particular embodiments hereinabove described, and includes all the technical equivalents within the scope of the claims, which follow.

In particular, the magnet and its receiving recess can have any appropriate form.

Several magnets can be provided on the locking mechanism, and/or the magnet can be arranged on the ski pole as previously described, which means that the magnet is located in the actuating member.

Other modes for positioning the magnet can be provided, particularly so as to have a direct contact surface with the tip of the pole.

The article can be something other than a retaining device or part of a device. It can be, for example, a mounting wedge.

The invention claimed is:

1. An article to be associated with a sports apparatus, said article comprising:

a control mechanism movable at least between a locking position and an unlocking position;

the control mechanism comprising a control member having an inner recess and an outer recess;

the inner recess being closed from a side of the control mechanism not adapted to face toward the sports apparatus during use of the article;

said control mechanism comprising an attraction arrangement to attract an actuating member, said actuating member being separate from the article;

the attraction arrangement comprising:

a magnet for attracting a portion of said actuating member; or a piece for attracting a magnetic portion of said actuating member;

the magnet or the piece being housed in said inner recess;

the outer recess facing away from the sports article during use of the article and structured and arranged for being engaged by the actuating member.

2. An article according to claim 1, wherein:

said inner recess is downwardly facing.

3. An article according to claim 2, further comprising:

an arrangement for retaining the magnet in the recess.

4. An article according to claim 1, wherein:

the control member comprises a button comprising a material allowing transmission of a magnetic field therethrough.

5. An article according to claim 1, wherein:

the article comprises a device for retaining a boot on a cross-country ski.

6. An article according to claim 1, wherein:

the article comprises a device for retaining a front end of a boot on a cross-country ski, allowing a heel of the boot to be raised and lowered relative to the ski.

7. An article according to claim 5, wherein:

the article comprises a locking mechanism usable according to a single mode of operation.

8. An article according to claim 5, wherein:

the article comprises a locking mechanism usable according to two modes of operation.

9. An article according to claim 1, wherein:

the article comprises a device for retaining a boot on an alpine ski.

10. An article according to claim 1, wherein:

the article comprises a device for retaining a heel of a boot on an alpine ski.

11. An article according to claim 1, wherein:

the control member is a one-piece member.

12. An article according to claim 1, wherein:

the control member is a one-piece member made of a plastic material.

13. An article according to claim 1, wherein:

the control member is a one-piece member mounted for pivoting between said locking position and said unlocking position of the control mechanism.

14. An article according to claim 1, wherein:

the outer recess of the control member, at least at either of front and rear boundaries of the outer recess, is recessed within an adjacent outermost surface of the locking mechanism.

15. An article to be associated with a sports apparatus, said article comprising:

a control mechanism movable at least between a locking position and an unlocking position;

the control mechanism comprising an inner recess and an outer recess;

the inner recess being closed from a side of the control mechanism not adapted to face toward the sports apparatus during use of the article;

said control mechanism comprising an attraction arrangement to attract an actuating member, said actuating member being separate from the article;

the attraction arrangement comprising:

a magnet for attracting a portion of said actuating member; or a piece for attracting a magnetic portion of said actuating member;

the magnet or the piece being housed in said inner recess;

the outer recess facing away from the sports article during use of the article and structured and arranged for being engaged by the actuating member;

the outer recess having a lengthwise extent greater than a lengthwise extent of each of the magnet and the piece.

16. An article according to claim 15, wherein:

the outer recess includes a front end spaced forwardly of the magnet or the piece.

17. An article according to claim 15, wherein:

the outer recess includes a rear end spaced rearwardly of the magnet or the piece.

18. An article according to claim 15, wherein:

the outer recess includes a front end spaced forwardly of the magnet or the piece and a rear end spaced rearwardly of the magnet or the piece.

19. An article according to claim 15, wherein:

the control mechanism comprises a one-piece control member;

the control member comprising said inner recess and said outer recess.

20. An article according to claim 19, wherein:

the control member is made of a plastic material.

21. An article according to claim 15, wherein:

the outer recess of the control member, at least at either of front and rear boundaries of the outer recess, is recessed within an adjacent outermost surface of the locking mechanism.

* * * * *